United States Patent [19]

Bergh

[11] 4,102,045

[45] Jul. 25, 1978

[54] HAND TOOL FOR CUTTING ENDS OF DECORATIVE MOLDING

[75] Inventor: Eugene H. Bergh, St. Paul, Minn.

[73] Assignee: Minnesota Mining and Manufacturing Company, St. Paul, Minn.

[21] Appl. No.: 778,382

[22] Filed: Mar. 17, 1977

[51] Int. Cl.[2] ..... B26B 29/00

[52] U.S. Cl. ..... 30/287; 30/178; 30/179; 30/299

[58] Field of Search ..... 30/287, 299, 179, 178, 30/229, 233, 293

[56] References Cited

U.S. PATENT DOCUMENTS

| | | | |
|---|---|---|---|
| 1,228,431 | 6/1917 | Hanson | 30/287 UX |
| 2,370,733 | 3/1945 | Jones | 30/91.2 X |
| 2,493,513 | 1/1950 | Wagner | 30/178 |
| 2,612,686 | 10/1952 | Wagner | 30/287 X |
| 2,725,774 | 12/1955 | Tekse | 30/91.2 X |
| 3,936,935 | 2/1976 | Gregory | 30/179 |

*Primary Examiner*—Gary L. Smith
*Assistant Examiner*—J. T. Zatarga
*Attorney, Agent, or Firm*—Cruzan Alexander; Donald M. Sell; John C. Barnes

[57] ABSTRACT

A hand tool designed to cut across a length of decorative wide body molding material and simultaneously shape the cut end to receive an insert piece cut by the same hand tool from scrap molding material to form a finished end for a molding strip. The tool makes the two cuts in the molding material to provide the cut end on the strip and an insert when the molding is placed in the tool against angularly related guide members.

3 Claims, 10 Drawing Figures

HAND TOOL FOR CUTTING ENDS OF DECORATIVE MOLDING

BACKGROUND OF THE INVENTION

1. Field of the Invention

The invention relates to a hand tool to provide a body molding applicator complete flexibility to create a finished end on a wide decorative molding strip applied to a product by pressure-sensitive adhesive.

2. Description of the Prior Art

In the prior art the moldings forming trim strips have generally been preformed to exact length and formed with finished ends or extruded material is later cut to form a finished end.

U.S. Pat. No. 3,959,538, issued May 25, 1976 to Theodore Loew illustrates several die patterns used for severing an extruded molding to be used for a trim strip. The various die configurations illustrated afford means for cutting the end of the molding and then bending the severed portions of the molding together to form a finished end. In each of these configurations illustrated it is necessary to bend and close together portions of the cut end. These earlier known cutting tools form an end and the bent portions apply a shearing stress in the pressure-sensitive adhesive which is used to bond the molding to the receptor.

The tool of the present invention is designed such that an autobody side molding applicator can utilize decorative molding purchased in bulk rolls and make on the spot end forms which look like they were formed in the factory. A single tool is used to make an end form to provide a termination to a strip of the decorative molding. The end form is made by positioning the molding in the tool against one set of guide members and making a cut through the molding. A second cut is made from a piece of scrap molding which is placed in the hand tool against the second set of guides to cut from the side of the scrap molding the insert which will fit precisely into the cut formed in the end of the strip to complete the end form. An insert as described defines an end for the molding which does not result in any stress being applied to the pressure-sensitive adhesive on the surface of the molding attached to the autobody or other surface to be protected and/or decorated.

SUMMARY OF THE INVENTION

The present invention provides a hand tool which can cut decorative molding strips at the site of application and form on the ends thereof a termination which is pleasant in appearance. The hand tool comprises an anvil which is plate-like and formed of a polymeric material and having a support surface shaped to support a surface of the decorative molding product. The polymeric material is such that it can recover its shape after being struck with the edge of a cutter made of a rule die supported in a block. Supported on the anvil are also wall members which define angularly disposed first and second guide surfaces for positioning an edge of the molding product in first and second fixed locations during cutting operations. The rule die or cutting knife is supported on a second platen for cutting said molding product. The angle of the cut for the rule die coincides with feature lines of the decorative molding such that the end form of the finished molding has an appearance as though it were a one-piece molding from the factory. The tool further comprises a handle and a lever which is pivotally connected to the handle. The handle and lever have jaw members fixed thereto for supporting the anvil and the support platen for a rule die. Manipulation of the tool will cause the lever and handle to move the jaw members toward one another causing the rule die to cut through the decorative molding placed against the guide surfaces and on the anvil.

The above features and advantages of the present invention will be more fully understood after a careful reading of the following detailed description which refers to the accompanying drawing.

DETAILED DESCRIPTION OF THE PRESENT INVENTION

Figure 1:
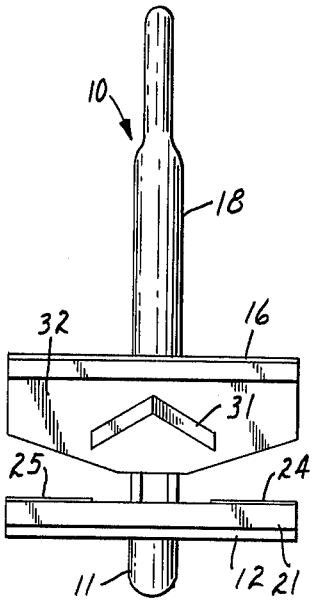
FIG. 1 is an end view of a hand tool constructed according to the present invention.
Figure 2:
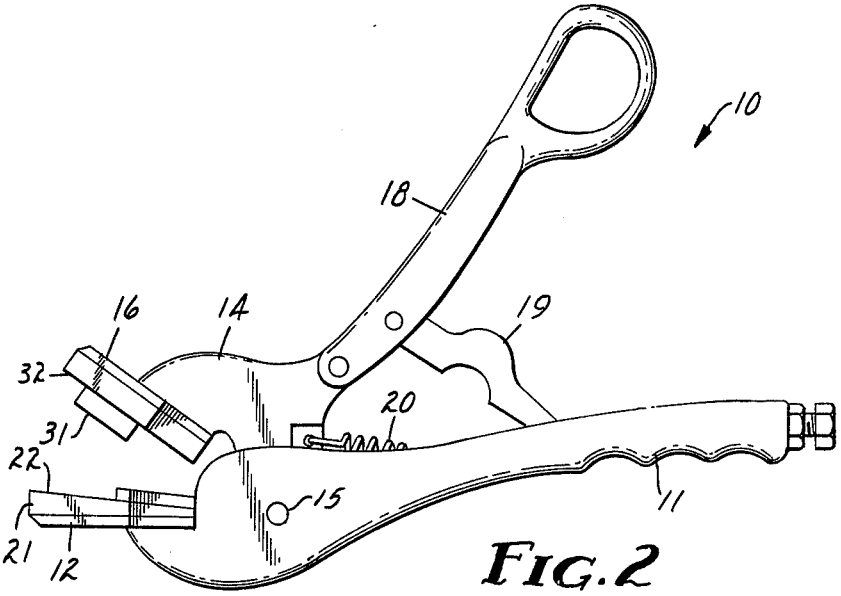
FIG. 2 is a side elevational view of a hand tool constructed in accordance with the present invention.
Figure 3:
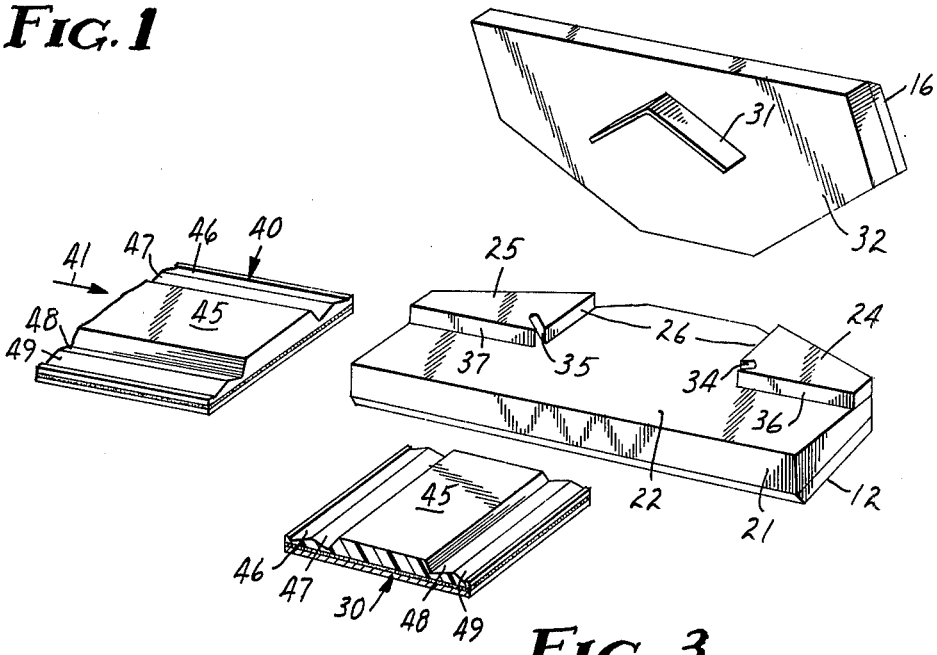
FIG. 3 is an enlarged detail view of a fixture comprising an anvil, guides and cutter for the tool illustrating also the positions of the elongate decorative molding as it is moved into the die.

Referring now to FIGS. 1, 2 and 3 there is shown a hand tool 10 comprising a handle 11 terminating at one end in a jaw member 12. A lever 14 is mounted pivotally by axis 15 to the handle 11 and supports a jaw member 16. A toggle linkage is utilized to pivot the lever 14 about the axis 15 and this comprises a thumb-operated lever 18 which is pivotally connected to one end of the lever 14 and it is pivotally connected intermediate its ends to a lever 19 which causes the pivoted end of the lever to move away from the handle 11 upon pressure being applied between the free end of the lever 18 and the handle 11. Pressure on lever 18 toward the handle 11 causes lever 14 to pivot about pin 15 against the bias of a spring 20 to move the jaw 16 toward the jaw member 12.

Secured to the lower jaw member 12 on the handle 11 is an anvil 21 on which there is a surface 22 shaped to fully support and mate with a surface of the decorative molding material. As illustrated, this surface 22 is generally planar with a front and rear edge. Wall members are supported on the anvil adjacent the rear edge and define two pairs of guides for edges of the molding product. As illustrated in FIG. 3 the guide members are defined by a pair of blocks 24 and 25. The blocks have opposed surfaces 26 which define one guide for a molding product 30. When an end of the molding product 30 is inserted between the walls 26 it is held in a first predetermined transverse position with respect to a cutter 31, which is an uninterrupted cutting knife or rule die held in a support block 32, which may be wooden, on the jaw member 16. The ends of the knife 31 fit in notches 34 and 35 of the blocks 24 and 25, respectively, to completely cut the molding material 30 across the width thereof, and a vertex of the knife contacts the surface 22 adjacent the front edge. Blocks 24 and 25 also have parallel aligned walls 36 and 37 which form a second guide for an edge of the molding material 40 perpendicular to the first guide. When the material is moved in the direction of arrow 41 onto the support surface 22 it will engage the surfaces 36 and 37 and extend generally parallel to the knife so an insert can be cut from the edge of a scrap piece of the molding 40 as will hereinafter be described.

Figure 4A:
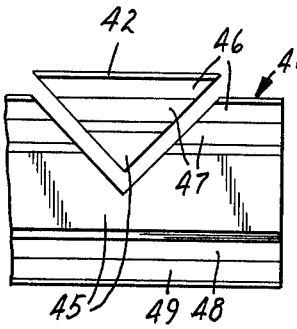
FIGS. 4A, 4B, and 4C illustrate the cutting of the decorative molding and one form of the finished end.
Figure 4B:
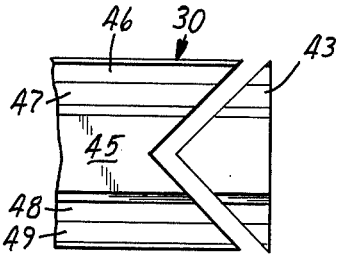
Figure 4C:
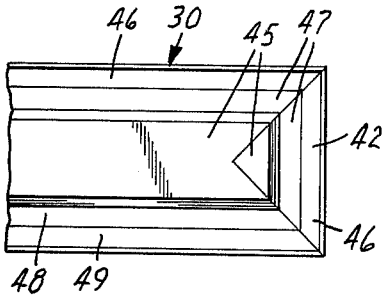

Referring now to FIG. 4A there is shown the cutting of the molding material 40 along an edge thereof to cut from said edge a triangular insert portion 42. In FIG. 4B there is illustrated the molding strip 30 having a cut formed across the width thereof to form the end of the molding strip 30 from the end of the material as illustrated by numeral 43. FIG. 4C now shows the insert 42 being placed into the cut end on the strip 30 forming a finished end for the strip 30 or an end form which has the appearance of a factory molded decorative strip. The cut formed by the knife 31 and the anvil 21 is at the feature lines and adapted such that the cuts made by the knife will mate the feature lines of the molding at the end of a strip. As illustrated in FIG. 3 the molding has a series of ridges and grooves extending the length thereof. The surface 45 may have a matte finish and the surfaces 46, 47, 48, and 49 may have a reflective vapor coat applied thereto to give the extruded polymeric molding the appearance of a metal trim. Thus, the cuts made by the knife 31 and anvil 21 are so formed that the vaporized coatings appear to be continuous about the end form of the strip 30 as illustrated in 4C.

Figure 5:
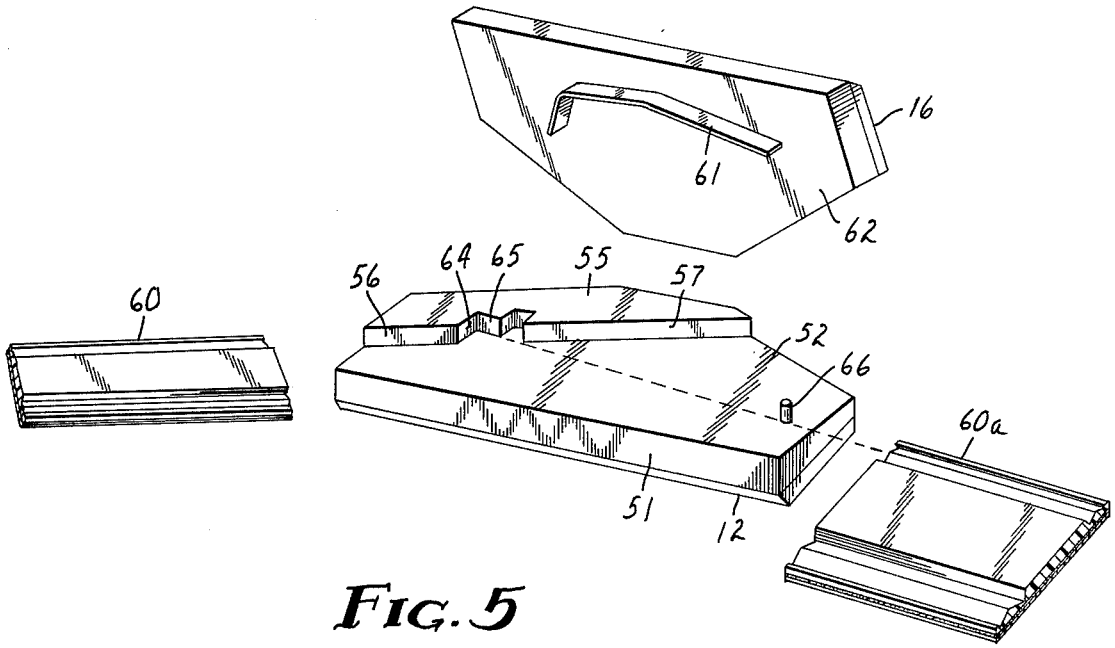
FIG. 5 illustrates a second embodiment of the present invention and shows a fixture for performing a cut to define a pointed end form for the decorative molding and the positions for the decorative molding.
Figure 6A:
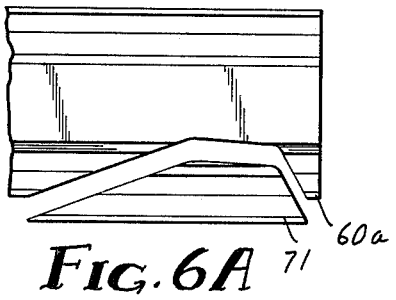
FIGS. 6A, 6B and 6C illustrate the cutting of a decorative molding and an alternative embodiment of the finished end form.
Figure 6B:
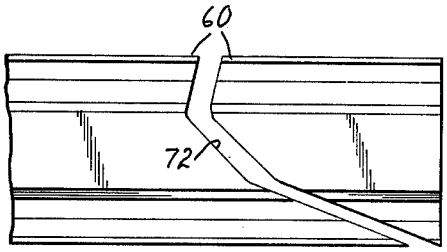
Figure 6C:
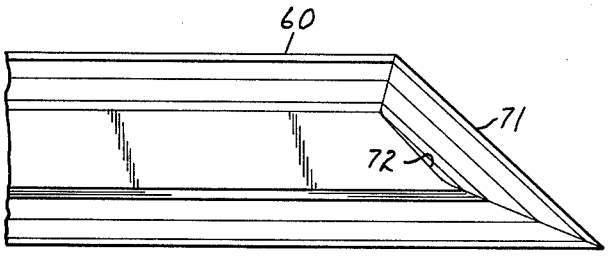

FIG. 5 illustrates a second embodiment for the anvil and cutting knife. The anvil 51 or plate is formed of a polymeric material which is soft and has a planar surface 52 with a front and rear edge to support the planar bottom surface of the molding strip as illustrated by the reference numeral 60. Also positioned on the anvil 51 are wall means defining two pairs of guide surfaces adjacent the rear edge thereof. One pair of guide surfaces are defined by a guide block 55 which has spaced edge surfaces 56 and 57 to align a strip of molding 60 on the surface 52 in a desired position with respect to a cutter 61 which may be formed of a rule die or knife supported in a support block 62 mounted onto jaw member 16 and having ends to contact the anvil adjacent the rear edge and a vertex to contact the anvil adjacent the front edge. The guide block 55 is also formed with a notch defined by surfaces 64 and 65 which receive one end of a molding as illustrated at 60A. A further guide member defined by the surface 65 and the surface of a pin 66 define the second pair of guide surfaces for the edge of the molding which is oblique or angularly related to the guide formed by the surfaces of walls 56 and 57. As the jaw members 12 and 16 move the knife 61 toward the anvil 51 with a strip disposed in either engagement with the guide member defined by the walls 56 and 57 or the guide surface defined by the wall 65 and the pin 66, the knife 61 will sever the molding. As illustrated in FIG. **6*a* when the molding is positioned against the guide defined by the wall 65 and the pin 66 an insert piece 71 is cut from the side of a piece of scrap molding 60*a*. When the molding 60 is disposed along the path defined by the walls 56 and 57 the cutter 61 will cut across the width of the molding 60 to form a cut end as shown at 72 in FIG. 6*b***.

The insert piece 71 may now be rotated and inserted against the cut end 72 to form a spear end defining a leading end for a strip of the molding material. As formed, the leading edge of the molding 60 has the appearance of the vapor-coated strips being continuous about the end of the decorative molding.

It can thus be seen that the die fixture can be formed to cut the end of the strip to length and with a predetermined pattern. The same die can then cut from a strip an insert to mate with the end and define a trim end form.

Further modifications as to the configuration of the end form and therefore to the cutter and guides may be made without departing from the spirit and the scope of this invention. It is preferred that the plates 21 and 51 be formed of a polymeric material which will not be permanently cut by the edge of the cutter. An example of such material for the plates 21 and 51 is a polyurethane having a Shore A hardness of greater than 80. Alternatively the anvils could be formed of materials such as polymethylmethacrylate, polycarbonate or a high density polyethylene for example of similar hardness or greater.

What is claimed is:

1. A hand tool for cutting and forming terminating ends on a flexible esthetic molding product, said tool comprising an anvil having a support surface with a front and a rear edge shaped to support a surface of said molding product and wall means adjacent said rear edge defining two pairs of angularly disposed guide surfaces for positioning an edge of said molding product in first and second fixed locations during cutting operations, an uninterrupted cutting knife having angularly disposed cutting edges between its ends with a vertex thereof contacting said support surface adjacent said front edge and the ends thereof contacting said support surface adjacent the rear edge for cutting said molding product when disposed on said anvil and contacting a pair of said guide surfaces, said cutting knife being adapted to cut a predetermined pattern in the molding product at an end thereof when the molding product is placed against a first pair of guide surfaces and to cut an insert to mate said end when the molding product is positioned against a second pair of guide surfaces, wherein said first pair of guide surfaces position a molding product transverse to said cutting knife and positioned between the ends of said knife to sever the molding product across its width and said second pair of guide surfaces define a path generally parallel to a line joining the ends of the cutting knife to cut an insert from an edge of the molding, a support member for supporting said knife, a handle, a lever pivoted on said handle, and a jaw member connected to each of said handle and lever for supporting said anvil and said support member for moving said knife through said molding product supported on said support surface upon relative movement between said handle and lever to bring said jaw members toward each other.

2. A hand tool according to claim 1 wherein said guide surfaces are perpendicular to each other.

3. A hand tool according to claim 1 wherein said guide surfaces form paths that are oblique.

* * * * *